US006989794B2

(12) United States Patent
Tran

(10) Patent No.: US 6,989,794 B2
(45) Date of Patent: Jan. 24, 2006

(54) WIRELESS MULTI-FREQUENCY RECURSIVE PATTERN ANTENNA

(75) Inventor: Allen Tran, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 10/371,676

(22) Filed: Feb. 21, 2003

(65) Prior Publication Data

US 2004/0164904 A1 Aug. 26, 2004

(51) Int. Cl.
*H01Q 1/24* (2006.01)

(52) U.S. Cl. ..... 343/702; 343/700 MS; 343/829

(58) Field of Classification Search ..... 343/700 MS, 343/792.5, 700, 702, 829
See application file for complete search history.

(56) References Cited

U.S. PATENT DOCUMENTS

| | | | |
|---|---|---|---|
| 6,127,977 | A | 10/2000 | Cohen |
| 6,140,975 | A | 10/2000 | Cohen |
| 6,281,846 | B1 | 8/2001 | Baliarda et al. |
| 6,300,914 | B1 | 10/2001 | Yang |

*Primary Examiner*—Michael C. Wimer

(57) ABSTRACT

A transceiver system using a recursive pattern antenna and a method for forming a recursive pattern antenna are provided. The antenna has a first shape and an effective electrical length, and a second shape radiator, modified from a recursively generated pattern of the first shape, with an effective electrical length. The radiator first shape can be a triangle, rectangle, or oval, for example. In some aspects, the antenna further comprises a third shape radiator, modified from a recursively generated pattern of the first shape, with an effective electrical length. Other aspects include a fourth shape radiator, modified from a recursively generated pattern of the first shape, with an effective electrical length. In one aspect, the different radiator effective electrical lengths are conducive to electro-magnetic communications in the range between 824 and 894 MHz, 1565 and 1585 MHz, 1850 and 1990 MHz, and 2400 and 2480 MHz.

68 Claims, 5 Drawing Sheets

WIRELESS MULTI-FREQUENCY RECURSIVE PATTERN ANTENNA

BACKGROUND OF THE INVENTION

1. Field of the Invention

This invention generally relates to wireless communications antennas and, more particularly, to a multi-frequency recursive pattern antenna and a method for forming the same.

2. Description of the Related Art

As noted in U.S. Pat. No. 6,140,975 (Cohen), antenna design has historically been dominated by Euclidean geometry. In such designs, the closed antenna area is directly proportional to the antenna perimeter. For example, if one doubles the length of an Euclidean square (or "quad") antenna, the enclosed area of the antenna quadruples. Classical antenna design has dealt with planes, circles, triangles, squares, ellipses, rectangles, hemispheres, paraboloids, and the like. Similarly, resonators, typically capacitors coupled in series and/or parallel with inductors, traditionally are implemented with Euclidian inductors. The prior art design philosophy has been to pick a Euclidean geometric construction, e.g., a quad, and to explore its radiation characteristics, especially with emphasis on frequency resonance and power patterns. The unfortunate result is that antenna design has far too long concentrated on the ease of antenna construction, rather than on the underlying electro-magnetics.

One non-Euclidian geometry is fractal geometry. Fractal geometry may be grouped into random fractals, which are also termed chaotic or Brownian fractals and include a random noise components, or deterministic fractals. In deterministic fractal geometry, a self-similar structure results from the repetition of a design or motif (or "generator"), on a series of different size scales. This repetition of a pattern into different size scales is referred to herein as recursively generated patterns.

Experimentation with non-Euclidean structures has been undertaken with respect to electro-magnetic waves, including radio antennas. Prior art spiral antennas, cone antennas, and V-shaped antennas may be considered as a continuous, deterministic first order fractal, whose motif continuously expands as distance increases from a central point. Unintentionally, first order fractals have been used to distort the shape of dipole and vertical antennas to increase gain, the shapes being defined as a Brownian-type of chaotic fractals. First order fractals have also been used to reduce horn-type antenna geometry, in which a double-ridge horn configuration is used to decrease resonant frequency. The use of rectangular, box-like, and triangular shapes as impedance-matching loading elements to shorten antenna element dimensions is also known in the art.

Whether intentional or not, such prior art attempts to use a quasi-fractal or fractal motif in an antenna employ at best a first order iteration fractal. By first iteration it is meant that one Euclidian structure is loaded with another Euclidean structure in a repetitive fashion, using the same size for repetition.

Antennas designed with fractal generators and a number of iterations, which is referred to herein as fractal geometry, appear to offer performance advantages over the conventional Euclidian antenna designs. Alternately, even if performance is not improved, the fractal designs permit antennas to be designed in a new form factor. However, the form factor of a fractal antenna need not necessarily be smaller than a comparable Euclidian antenna, and it need not fit within the constraints of a portable wireless communication device package.

More critically, a fractal geometry antenna has limitations with respect to the resonating frequency bands. Fractal pattern iterations have a precise mathematical relationship. As a result, the resonating frequencies of a fractal antenna have a predetermined spacing between resonances. For example, the fundamental antenna structure may resonate at cellular band frequencies of 824 to 894 megahertz (MHz). The first fractal pattern iteration of such an antenna would create structures that resonant at 1648 to 1788 MHz (twice the initial frequency). This higher frequency band is of little use if the antenna is expected to operate in the cellular band and either the PCS band (1850 to 1990 MHz), or the global positioning satellite (GPS) band at 1565 to 1585 MHz.

It would be advantageous if some of the general concepts of fractal geometry antennas could be used to build an antenna that resonated at frequency bands non-proportionately related.

SUMMARY OF THE INVENTION

The present invention describes a recursive pattern antenna that resonates at a plurality of non-harmonically related frequencies, as well as at frequencies that are not necessarily proportionately related. The recursive patterns are typically modifications of fractal geometry iterations that permit the antenna to be tuned to selected frequency bands.

Accordingly, a recursive pattern antenna is provided comprising a radiator having a first shape and a first effective electrical length and at least one radiator having a second shape, typically modified from a recursively generated pattern of the first shape, with a second effective electrical length. The radiator first shape can be triangles, rectangle, or ovals, for example. In some aspects, the antenna further comprises at least one radiator having a third shape, typically modified from a recursively generated pattern of the first shape, with a third effective electrical length. Other aspects include at least one radiator having a fourth shape, typically modified from a recursively generated pattern of the first shape, with a fourth effective electrical length.

In one aspect, the radiator first shape has a first effective electrical length conducive to electro-magnetic communications in the range between 824 and 894 MHz. The radiator second shape has a second effective electrical length conducive to electro-magnetic communications in the range between 1565 and 1585 MHz. The radiator third shape has a third effective electrical length conducive to electro-magnetic communications in the range between 1850 and 1990 MHz. The radiator fourth shape has a fourth effective electrical length conducive to electro-magnetic communications in the range between 2400 and 2480 MHz.

Additional details of the above-mentioned recursive pattern antenna, a transceiver system using a recursive pattern antenna, and a method for forming a recursive pattern antenna for wireless communications are provided below.

DETAILED DESCRIPTION OF THE PREFERRED EMBODIMENTS

Figure 2:
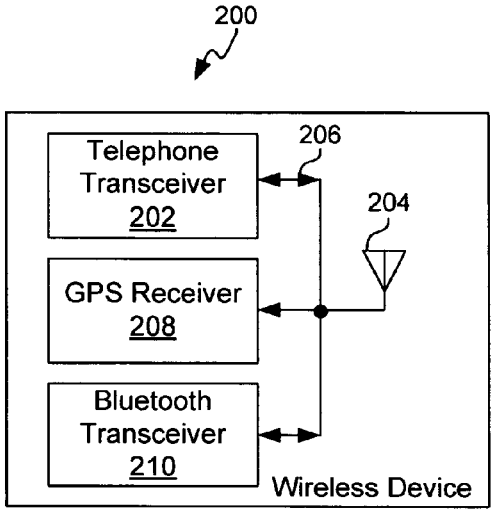
FIG. 2 is a schematic block diagram of the present invention transceiver system with a recursive pattern antenna.

FIG. 2 is a schematic block diagram of the present invention transceiver system with a recursive pattern antenna. The system 200 comprises a wireless communication device transceiver 202 and a recursive pattern antenna 204. As explained in more detail below, the recursive pattern antenna 204 includes a plurality of radiators having a recursive pattern relationship. Alternately as explained below, the recursive pattern antenna 204 includes a plurality of radiators having a modified recursive pattern relationship.

In some aspects of the system 200, the transceiver 202 has a wireless communications port on line 206 and the antenna 204 has an interface connected to the transceiver communications port on line 206 for radiating electro-magnetic energy in the frequency range between 824 and 894 MHz. That is, the antenna 204 has a first effective electrical length approximately equal to one-half of a wavelength in the frequency range between 824 and 894 MHz. It is assumed herein that other half wavelength measurements, such as 3/2 or 5/2 of a wavelength, are equivalent to one-half (1/2) wavelength. In other aspects, the antenna 204 has an interface connected to the transceiver communications port on line 206 for radiating electro-magnetic energy in the frequency range between 1850 and 1990 MHz. That is, the antenna 204 has a third effective electrical length approximately equal to one-half of a wavelength in the frequency range between 1850 and 1990 MHz.

In some aspects, the system 200 includes a global positioning system (GPS) receiver 208 with a wireless communications port on line 206 and the antenna 204 has an interface connected to the GPS receiver communications port on line 206 for accepting electro-magnetic radiated energy in the frequency range between 1565 and 1585 megahertz (MHz). The antenna 204 has a second effective electrical length approximately equal to one-half of a wavelength in the frequency range between 1565 and 1585 MHz.

In some aspects, the system 200 includes a Bluetooth transceiver 210 with a wireless communications port on line 204 and the antenna has an interface connected to the Bluetooth transceiver communications port for radiating electro-magnetic energy in the frequency range between 2400 and 2480 MHz. The antenna 204 has a fourth effective electrical length approximately equal to one-half of a wavelength in the frequency range between 2400 and 2480 MHz.

Figure 1A:
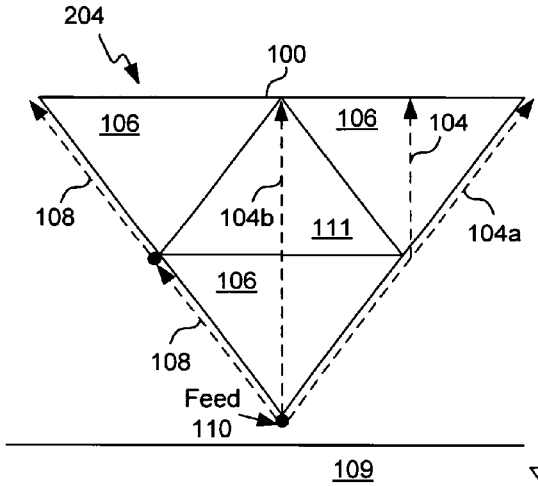
FIGS. 1*a* through 1*c* are exemplary plan view versions of the recursive pattern antenna of FIG. 1 depicted as a monopole antenna.
Figure 1B:
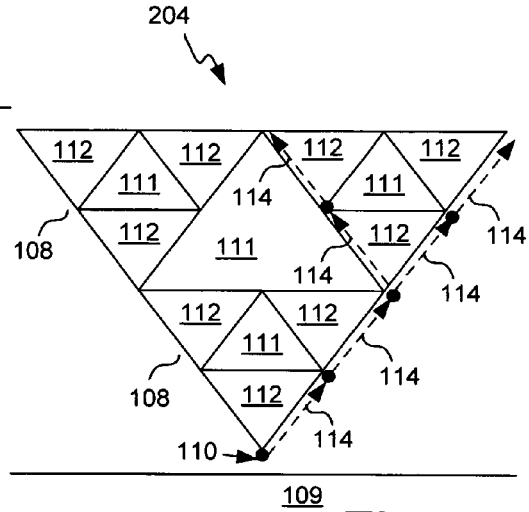
Figure 1C:
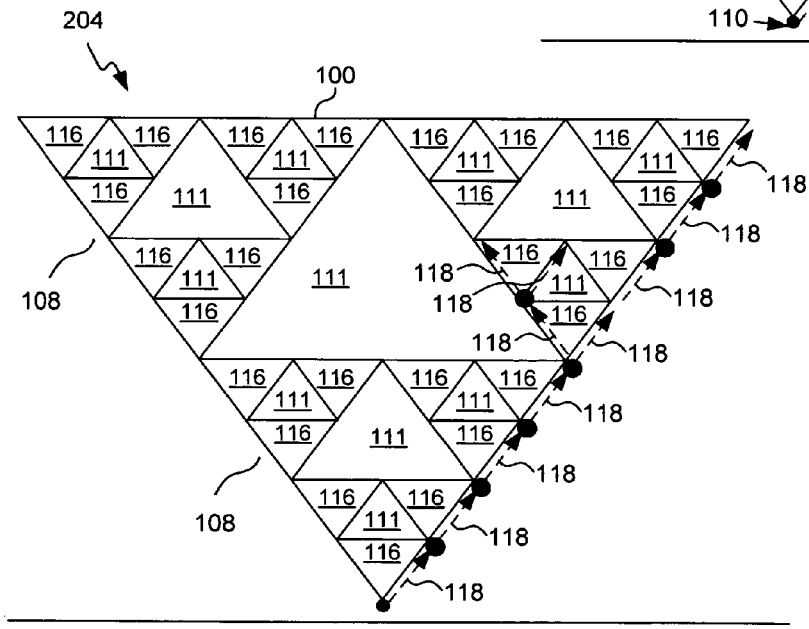

FIGS. 1*a* through 1*c* are exemplary plan view versions of the recursive pattern antenna 204 of FIG. 1 depicted as a monopole antenna. Generally, whether the antenna 204 is a monopole antenna, a dipole antenna (see FIGS. 3*a*–3*c*), or a patch antenna (see FIGS. 4*a* through 4*c* or FIG. 6), the antenna 204 (see FIG. 1*a*) comprises a radiator 100 having a first shape and the first effective electrical length 104 (as explained above in the description of FIG. 2). The antenna 204 also includes at least one radiator 106 having a second shape, from a recursively generated pattern of the first shape, with the second effective electrical length 108 as described above. Note that the second electrical length can be one of a number of half wavelength measurements, such as 3/2, 5/2, and so on, equivalent to one-half a wavelength.

The radiator 100 is in the proximity of a groundplane 109. By recursively generated pattern it is meant that the shape dimensions have a constant proportional relationship between iterations, typically but not always based on an integer or whole-number. For example, the first shape can be twice the size of the second iteration shape, or the second shape can be one-half the size of the first shape. In some aspects as explained below, the second shape radiator 106 is a modified recursively generated pattern of the first shape.

The radiator 100 first shape can be any one of a number of conventional shapes such as a triangle, a rectangle, or oval, where a circular shape is considered to be a special case of an oval. As shown in the example of FIG. 1*a*, the first shape is a triangle. Depending on the placement of the feedpoint 110 and nature of the first shape, the electrical length can vary. For example, the electrical length 104 is slightly different than the length 104*a*. It should also be understood that current flow through different regions of the radiator 100 may tend to emphasize one variation of electrical length over another.

It should also be understood that when modified, the second shape radiator(s) 106 is not truly recursively generated from the first shape radiator 100. That is, the second shape triangle dimensions are not exactly whole-number proportional to the first shape triangle. Neither are the proportional relationships between iterations necessarily the same. Further, the proportional relationship between the first shape radiator and particular second shape radiators may vary. In the case shown, the second shape triangle is not exactly one-half of the first shape triangle. That is, the recursive pattern is a modification of a 1/2 recursive iteration. The generation and placement of the second shape radiator(s) 106 necessarily changes the first effective electrical length from the initial condition (see electrical length 104*b*), before the placement of the void area 111 associated with the formation of the second shape radiators. The void areas can be areas of exposed dielectric or groundplane where the conductive surface of radiator 100 has been removed. Likewise, the exact dimensions of the second shape radiator(s) 106 typically need to be adjusted to achieve the desired second effective electrical length. It should also be noted that the second shape radiators 106 need not have identical shapes. The present invention antenna recursive patterns are not limited to a modification of any particular whole-number, or any other number relationship.

As seen in FIG. 1*b*, in some aspects the antenna 204 includes at least one radiator 112 having a third shape, from a recursively generated pattern of the first shape, with the third effective electrical length 114 as described above in the explanation of FIG. 2. Note that the third electrical length can be one of a number of half wavelength measurements, such as 3/2, 5/2, and so on, equivalent to one-half a wavelength. In some aspects, the third shape radiator is modified from a recursively generated pattern of the first shape, as explained above.

As seen in FIG. 1*c*, in some aspects the antenna 204 includes at least one radiator 116 having a fourth shape, either from a recursively generated pattern of the first shape or modified from a recursively generated pattern of the first shape, with the fourth effective electrical length 118 as described above. Note that the fourth electrical length can be one of a number of half wavelength measurements, such as 3/2, 5/2, and so on, equivalent to one-half a wavelength. Although three recursive iterations are demonstrated in FIG. 1*c*, it should be understood that the present invention antenna 204 is not limited to any particular number of recursive pattern iterations. Generally, the radiator (or counterpoise, see FIGS. 3*a*–3*c*) includes X second shape sections, (up to a maximum of) $X^2$ third shape sections, and (up to a maximum of) $X^4$ fourth shape sections. As shown, X is equal to three.

Figure 3A:
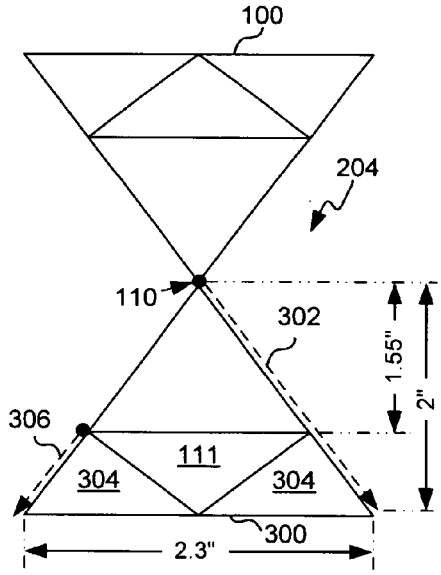
FIGS. 3*a* through 3*c* are exemplary plan view versions of the recursive pattern antenna of FIG. 1 depicted as a bow tie dipole antenna.
Figure 3B:
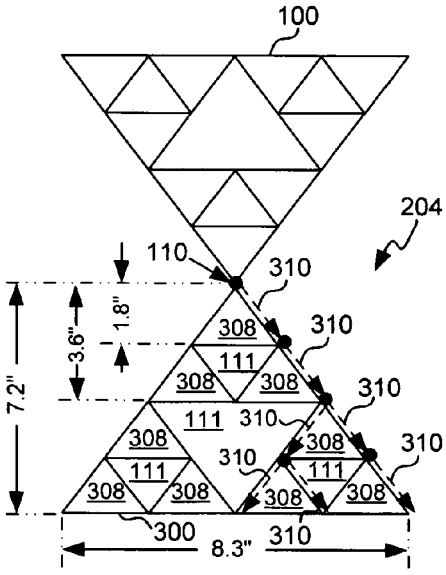

FIGS. 3*a* through 3*b* are exemplary plan view versions of the recursive pattern antenna 204 of FIG. 1 depicted as a bow tie dipole antenna. The explanation of the radiator first and second shapes, with corresponding first and second effective electrical lengths, mirrors the description of FIG. 1*a* and will not be repeated in the interest of brevity. As with the radiator, the recursive pattern antenna 204 includes a counterpoise having the first shape and the first effective electrical length and a plurality of counterpoises having a recursive pattern relationship with the first shape. Although a triangular shape is shown, the antenna could alternately be enabled with other shapes. In FIG. 3*a* the antenna 204 further comprises a counterpoise 300 having a first shape and the first effective electrical length 302. The antenna 204 includes at least one counterpoise 304 having a second shape, either from a recursively generated pattern of the first shape or modified from a recursively generated pattern of the first shape, with the second effective electrical length 306. Also shown is feed point 110 and void area 111. In other aspects of the invention as shown, the second shape radiator 304 has the fourth electrical length. That is, the antenna resonates in the cellular band and in the Bluetooth band of frequencies. Also shown are some key antenna dimensions in inches. Note that the second electrical length can be one of a number of half wavelength measurements, such as 3/2, 5/2, and so on, equivalent to one-half a wavelength.

As shown in FIG. 3*b*, the antenna 204 includes a radiator 100 as explained in the description of FIG. 1*b*, and further comprises at least one counterpoise 308 having a third shape, from a recursively generated pattern of the first shape or modified from a recursively generated pattern of the first shape, with the third effective electrical length 310. Also shown are some key dimensions in inches. Note that the third electrical length can be one of a number of half wavelength measurements, such as 3/2, 5/2, and so on, equivalent to one-half a wavelength.

Figure 3C:
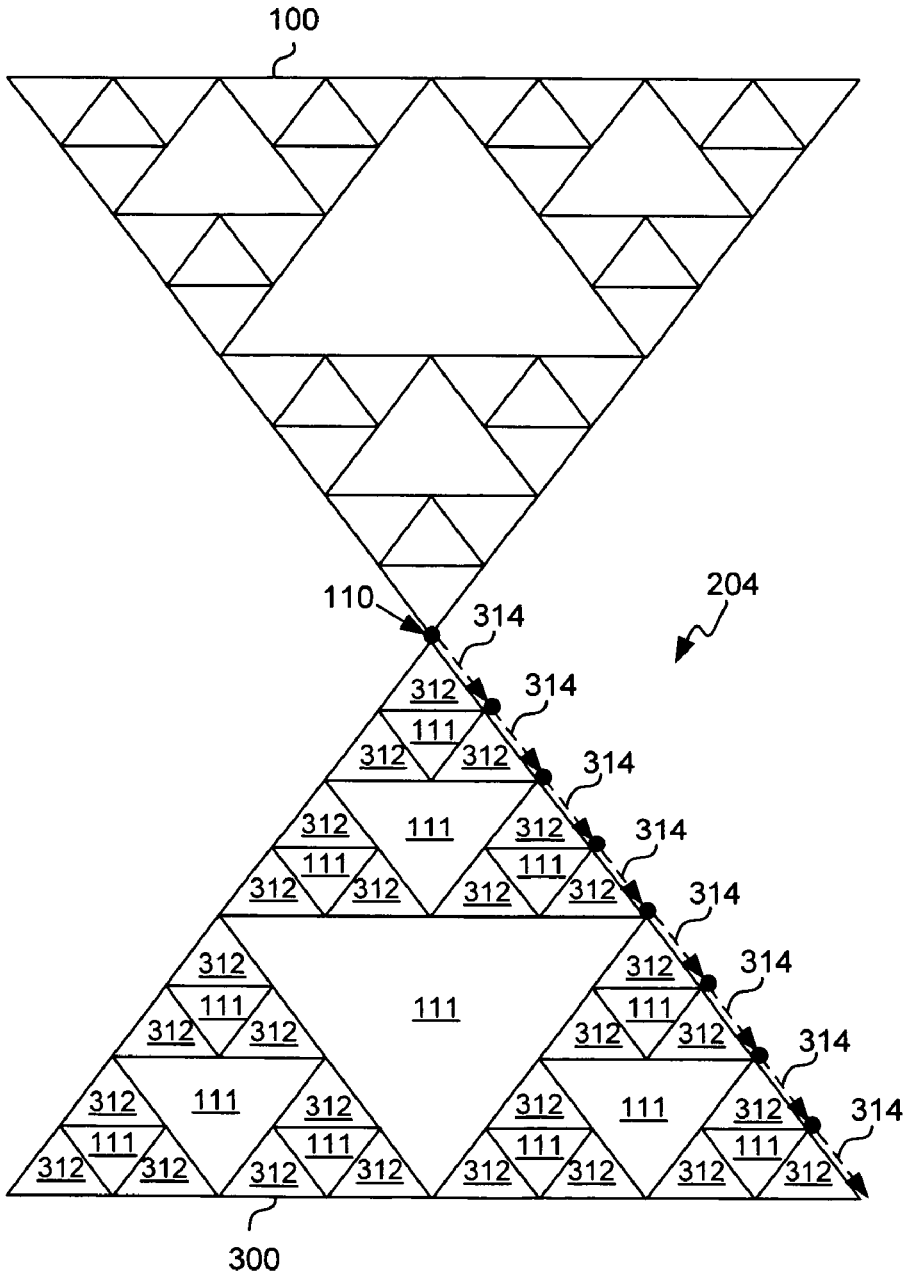

As shown in FIG. 3*c*, the antenna includes a radiator as explained in the description of FIG. 1*c*, and further comprises at least one counterpoise 312 having a fourth shape, either from a recursively generated pattern of the first shape, or modified from a recursively generated pattern of the first shape, with the fourth effective electrical length 314. Note that the fourth electrical length can be one of a number of half wavelength measurements, such as 3/2, 5/2, and so on, equivalent to one-half a wavelength. Each radiator and counterpoise section is shown as a triangle. As shown, the radiator and counterpoise sections each include three second triangle sections, nine third triangle sections, and twenty-seven fourth triangle sections. The efficiency of the antenna to resonate at specific electrical lengths can be adjusted by selecting the number and placement of second, third, and fourth sections in the radiator (and counterpoise).

Figure 4A:
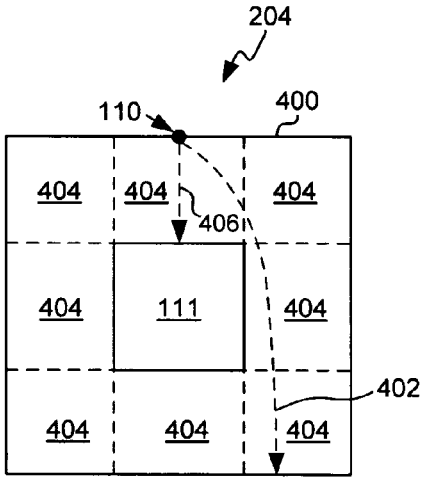
FIGS. 4*a* through 4*c* are exemplary plan view versions of the recursive pattern antenna of FIG. 1 depicted as a rectangular patch antenna.
Figure 4B:
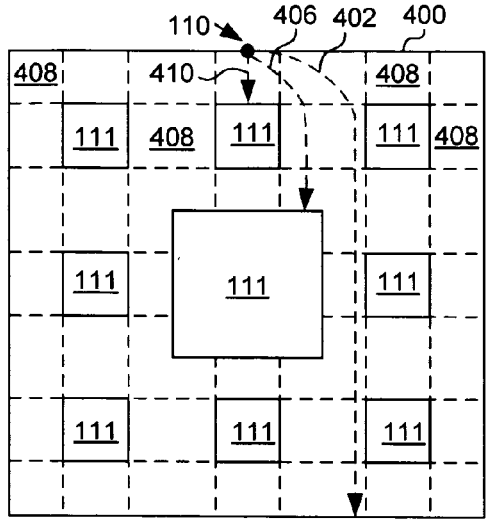
Figure 4C:
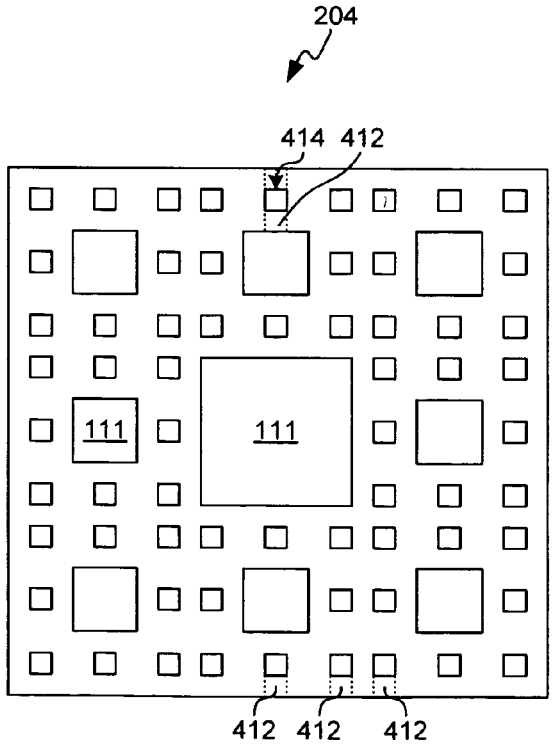

FIGS. 4*a* through 4*c* are exemplary plan view versions of the recursive pattern antenna 204 of FIG. 1 depicted as a rectangular patch antenna. As shown in FIG. 4*a*, the antenna 204 has a radiator conductive section 400 shaped as a first rectangle having the first effective electrical length 402. In other aspects of the antenna, the radiator conductive section 400 can be circular or triangular. Also shown is a feed point 110 and a void area 111. Generally, the recursive rectangle pattern patch antenna 204 includes a plurality of rectangular radiators having a recursive pattern relationship, as described above. Alternately, the recursive pattern antenna 204 includes a plurality of radiators having a modified recursive pattern relationship, as described above. The plurality of radiators are conductors formed overlying a dielectric layer (not shown). The dielectric layer overlies a groundplane (not shown). As shown, the antenna 204 includes at least one conductive section 404 shaped as a second rectangle having the second effective electrical length 406. Note that the second electrical length can be one of a number of half wavelength measurements, such as 3/2, 5/2, and so on, equivalent to one-half a wavelength.

In FIG. 4*b* the antenna 204 includes at least one conductive section 408 shaped as a third rectangle having the third effective electrical length 410. Note that depending upon the exact size and placement of the third rectangle sections 408, many other third electrical length paths would be possible. Also note that the third electrical length can be one of a number of half wavelength measurements, such as 3/2, 5/2, and so on, equivalent to one-half a wavelength.

In FIG. 4*c* the antenna 204 includes at least one conductive section 412 shaped as a fourth rectangle having a fourth effective electrical length 414. As noted above, other fourth electrical length paths are possible in some aspects of the antenna. Also note that the fourth electrical length can be one of a number of half wavelength measurements, such as 3/2, 5/2, and so on, equivalent to one-half a wavelength. The antenna, as shown includes eight second rectangle sections, sixty-four third rectangle sections, and four thousand ninety-six fourth rectangle sections. However as noted above, a fewer number of second, third, and fourth rectangle sections are used in other aspects of the antenna.

Figure 6:
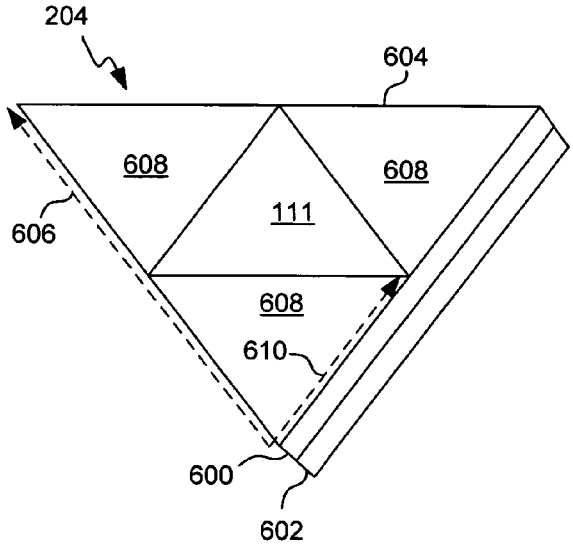
FIG. 6 is a perspective view of the present invention recursive pattern triangular patch antenna.

FIG. 6 is a perspective view of the present invention recursive pattern triangular patch antenna. The patch antenna 204 has an underlying dielectric 600 and groundplane 602. A radiator 604 has a first triangle shape and a first effective electrical length 606. At least one radiator 608 has a second triangle shape, modified from a recursively generated pattern of the first triangle shape 604, with a second effective electrical length 610.

In other aspects not shown, but equivalent to the descriptions of FIGS. 1*b* and 1*c*, at least one radiator has a third triangle shape, modified from a recursively generated pattern of the first triangle shape, with a third effective electrical length. Likewise, in other aspects at least one radiator has a fourth triangle shape, modified from a recursively generated pattern of the first triangle shape, with a fourth effective electrical length.

In some aspects, the radiator first triangle shape 604 has a first effective electrical length conducive to electro-magnetic communications in the range between 824 and 894 megahertz (MHz). The radiator second triangle shape 608 has a second effective electrical length conducive to electro-magnetic communications in the range between 1565 and 1585 MHz in some aspects. In other aspects, the third triangle shape has a third effective electrical length conducive to electro-magnetic communications in the range between 1850 and 1990 MHz, and the radiator fourth triangle shape has a fourth effective electrical length conducive to electro-magnetic communications in the range between 2400 and 2480 MHz.

Figure 5:
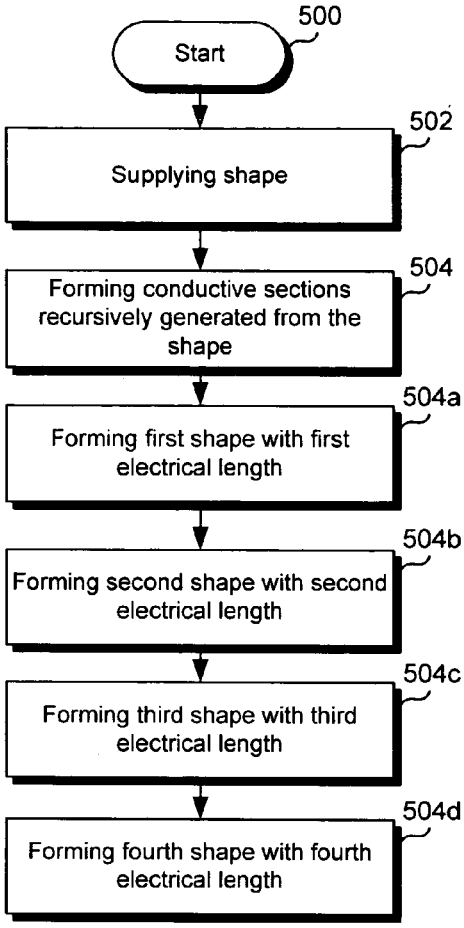
FIG. 5 is a flowchart illustrating the present invention method for forming a recursive pattern antenna for wireless communications.

FIG. 5 is a flowchart illustrating the present invention method for forming a recursive pattern antenna for wireless communications. Although this method is depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts at Step 500. Step 502 supplies a shape. Step 504 forms conductive sections recursively generated from the shape, having effective electrical lengths. In alternate aspects, non-conductive sections are recursively generated.

In some aspects of the method, forming conductive sections in Step 504 includes forming a recursively generated first shape in a plurality of effective electrical lengths. Alternately, Step 504 forms a recursively generated first shape modification in a plurality of effective electrical lengths.

In some aspects, forming a recursively generated first shape in a plurality of effective electrical lengths in Step 504 includes substeps. Step 504*a* forms a first shape having a first electrical length. Step 504*b* forms a second shape having a second electrical length. Step 504*c* forms a third shape having a third electrical length. Step 504*d* forms a fourth shape having a fourth electrical length. As noted above, the present invention is not limited to any particular number of iterations.

In some aspects, forming a first shape having a first electrical length in Step 504*a* includes forming an electrical length conducive to electro-magnetic communications in the range of 824 and 894 megahertz (MHz). Forming a second shape having a second electrical length in Step 504*b* includes forming an electrical length conducive to electro-magnetic communications in the range of 1565 to 1585 MHz. Forming a third shape having a third electrical length in Step 504*c* includes forming an electrical length conducive to electro-magnetic communications in the range of 1850 to 1990 MHz. Forming a fourth shape having a fourth electrical length in Step 504*d* includes forming an electrical length conducive to electro-magnetic communications in the range of 2400 to 2480 MHz.

In other aspects, forming conductive sections in Step 504 includes forming an antenna selected from the group including patch, dipole, and monopole antennas.

In some aspects, forming conductive sections in Step 504 includes forming a bow tie dipole using a recursively generated triangular pattern. In other aspects, Step 504 forms a patch antenna using a recursively generated rectangular pattern. In other aspects, the pattern is circular, oval, or triangular.

A recursive pattern antenna and a method for forming the same are provided. Examples have been given of monopole, dipole, and patch antenna types. Although only one shape is typically exemplified per antenna type, the present invention can be enabled with a variety of shapes for each type. Examples have also been given of recursively generated shapes that have been modified to accommodate cellular (AMPS), PCS, GPS, and Bluetooth frequencies. However, the present invention is not limited to any particular frequencies. Other variations and embodiments of the invention will occur to those skilled in the art.

I claim:

1. A transceiver system comprising:

a wireless communication device telephone transceiver; and, a multiband recursive pattern antenna with a first plurality of radiators, including a first shape radiator and a second shape radiator, the first shape radiator having a proportional relationship with the second shape radiator based upon a whole number, the recursive pattern antenna including a second plurality of radiators, including a third shape radiator having a proportional relationship with the first shape radiator based upon a non-whole number.

2. The system of claim 1 wherein the telephony transceiver has a wireless communications port; and, wherein the antenna has an interface connected to the telephone transceiver communications port for radiating electro-magnetic energy in the frequency range between 824 and 894 MHz.

3. The system of claim 1 further comprising:

a global positioning system (GPS) receiver with a wireless communications port; and, wherein the antenna has an interface connected to the GPS receiver communications port for accepting electro-magnetic radiated energy in the frequency range between 1565 and 1585 megahertz (MHz).

4. The system of claim 1 wherein the telephony transceiver has a wireless communications port; and, wherein the antenna has an interface connected to the telephone transceiver communications port for radiating electro-magnetic energy in the frequency range between 1850 and 1990 MHz.

5. The system of claim 1 further comprising:

a Bluetooth transceiver with a wireless communications port; and, wherein the antenna has an interface connected to the Bluetooth transceiver communications port for radiating electro-magnetic energy in the frequency range between 2400 and 2480 MHz.

6. The system of claim 2 wherein the antenna has a first effective electrical length approximately equal to one-half of a wavelength in the frequency range between 824 and 894 MHz.

7. The system of claim 6 further comprising:

a global positioning system (GPS) receiver with a wireless communications port; and, wherein the antenna has an interface connected to the GPS receiver communications port, the antenna having a second effective electrical length approximately equal to one-half of a wavelength in the frequency range between 1565 and 1585 MHz.

8. The system of claim 7 wherein the antenna has a third effective electrical length approximately equal to one-half of a wavelength in the frequency range between 1850 and 1990 MHz.

9. The system of claim 8 further comprising:

a Bluetooth transceiver with a wireless communications port; and, wherein the antenna has an interface connected to the Bluetooth transceiver communications port, the antenna having a fourth effective electrical length approximately equal to one-half of a wavelength in the frequency range between 2400 and 2480 MHz.

10. A transceiver system comprising:

a wireless communication device telephone transceiver; and, a recursive bow tie pattern multiband dipole antenna with radiator and counterpoise conductive sections shaped as a first triangle having a first effective electrical length, and a first plurality of triangular radiators having a proportional relationship with the first triangle based upon a whole number.

11. The system of claim 10 wherein the radiator and counterpoise sections each include at least one conductive section shaped as a second triangle with a second effective electrical length.

12. The system of claim 11 wherein the radiator and counterpoise sections each include at least one conductive section shaped as a third triangle with a third effective electrical length.

13. The system of claim 12 wherein the radiator and counterpoise sections each include at least one conductive section shaped as a fourth triangle with a fourth effective electrical length.

14. The system of claim 13 wherein the radiator and counterpoise sections each include three second triangle sections, nine third triangle sections, and twenty-seven fourth triangle sections.

15. The system of claim 10 wherein the telephony transceiver has a communications port; and, wherein the antenna has an interface connected to the telephone transceiver communications port, the antenna having a first effective electrical length approximately equal to one-half of a wavelength in the frequency range between 824 and 894 megahertz (MHz).

16. The system of claim 15 wherein the wireless communications device includes a global positioning system (GPS) receiver with a wireless communications port; and, wherein the antenna has an interface connected to the GPS receiver communications port, the antenna having a second effective electrical length approximately equal to one-half of a wavelength in the frequency range between 1565 and 1585 MHz.

17. The system of claim 16 wherein the antenna has a third effective electrical length approximately equal to one-half of a wavelength in the frequency range between 1850 and 1990 MHz.

18. The system of claim 17 wherein the wireless communications device includes a Bluetooth transceiver with a wireless communications port; and, wherein the antenna has an interface connected to the Bluetooth transceiver communications port, the antenna having a fourth effective electrical length approximately equal to one-half of a wavelength in the frequency range between 2400 and 2480 MHz.

19. The system of claim 10 wherein the recursive pattern antenna includes a second plurality of triangular radiators having a proportional relationship with the first triangle based upon a non-whole number.

20. A transceiver system comprising:

a wireless communication device telephone transceiver; and, a recursive rectangular pattern multiband patch antenna with a radiator conductive section shaped as a first rectangle having a first effective electrical length, and a first plurality of rectangular radiators having a proportional relationship with the first rectangle based upon a whole number, the recursive pattern antenna including a second plurality of rectangular radiators having a proportional relationship with the first rectanale based upon a non-whole number.

21. The system of claim 20 further comprising:

a dielectric layer; and, wherein the first plurality of radiators are conductors formed overlying the dielectric layer.

22. The system of claim 20 wherein the antenna includes at least one conductive section shaped as a second rectangle having a second effective electrical length.

23. The system of claim 22 wherein the antenna includes at least one conductive section shaped as a third rectangle having a third effective electrical length.

24. The system of claim 23 wherein the antenna includes at least one conductive section shaped as a fourth rectangle having a fourth effective electrical length.

25. The system of claim 24 wherein the antenna includes eight second rectangle sections, sixty-four third rectangle sections, and four thousand ninety-six fourth rectangle sections.

26. The system of claim 22 wherein the telephony transceiver has a communications port; and, wherein the antenna has an interface connected to the telephone transceiver communications port, the antenna having a first effective electrical length approximately equal to one-half of a wavelength in the frequency range between 824 and 894 megahertz (MHz).

27. The system of claim 26 wherein the wireless communications device includes a global positioning system (GPS) receiver with a wireless communications port; and, wherein the antenna has an interface connected to the GPS receiver communications port, the antenna having a second effective electrical length approximately equal to one-half of a wavelength in the frequency range between 1565 and 1585 MHz.

28. The system of claim 27 wherein the antenna has a third effective electrical length approximately equal to one-half of a wavelength in the frequency range between 1850 and 1990 MHz.

29. The system of claim 28 wherein the wireless communications device includes a Bluetooth transceiver with a wireless communications port; and, wherein the antenna has an interface connected to the Bluetooth transceiver communications port, the antenna having a fourth effective electrical length approximately equal to one-half of a wavelength in the frequency range between 2400 and 2480 MHz.

30. A transceiver system comprising:

a wireless communication device telephone transceiver; and, a recursive pattern multiband antenna with a radiator conductive section having a first shape with a first effective electrical length, and including a first plurality of radiators with shapes that have a proportional relationship to the first shape based upon a whole number, the recursive pattern antenna including a plurality of further shape radiators having a proportional relationship with the first shape based upon a non-whole number.

31. The system of claim 30 wherein the recursive pattern antenna includes a counterpoise having the first shape and the first effective electrical length, and a plurality of counterpoises with shapes having a proportional relationship with the first shape based upon a whole number.

32. The system of claim 30 wherein the radiator includes at least one conductive section having a second shape having a second effective electrical length, the second shape having a proportional relationship with the first shape based upon a whole number.

33. The system of claim 32 wherein the radiator includes at least one conductive section having a third shape having a third effective electrical length, the third shape having a proportional relationship with the first shape based upon a whole number.

34. The system of claim 33 wherein the radiator includes at least one conductive section having a fourth shape having a fourth effective electrical length, the fourth shape having a proportional relationship with the first shape based upon a whole number.

35. The system of claim 34 wherein the radiator includes X second shape sections, $X^2$ third shape sections, and $X^4$ fourth shape sections.

36. The system of claim 32 wherein the telephony transceiver has a communications port; and, wherein the antenna has an interface connected to the telephone transceiver communications port, the antenna having a first effective electrical length approximately equal to one-half of a wavelength in the frequency range between 824 and 894 MHz.

37. The system of claim 36 wherein the wireless communications device includes a global positioning system (GPS) receiver with a wireless communications port; and, wherein the antenna has an interface connected to the GPS receiver communications port, the antenna having a second effective electrical length approximately equal to one-half of a wavelength in the frequency range between 1565 and 1585 MHz.

38. The system of claim 37 wherein the antenna has a third effective electrical length approximately equal to one-half of a wavelength in the frequency range between 1850 and 1990 MHz.

39. The system of claim 38 wherein the wireless communications device includes a Bluetooth transceiver with a wireless communications port; and, wherein the antenna has an interface connected to the Bluetooth transceiver communications port, the antenna having a fourth effective electrical length approximately equal to one-half of a wavelength in the frequency range between 2400 and 2480 MHz.

40. A recursive pattern multiband antenna comprising:

a radiator having a first shape and a first effective electrical length;

at least one radiator having a second shape, modified from a recursively generated pattern of the first shape, with a second effective electrical length, the second shape having a proportional relationship with the first shape based upon a non-whole numbers;

a counterpoise having a first shape and a first effective electrical length; and, at least one counterpoise having the second shape.

41. The antenna of claim 40 wherein the radiator first shape is selected from the group including triangles, rectangle, and ovals.

42. The antenna of claim 40 further comprising:

at least one radiator having a third shape with a third effective electrical length, the third shape having a proportional relationship with the first shape based upon a non-whole number.

43. The antenna of claim 42 further comprising:

at least one radiator having a fourth shape with a fourth effective electrical length, the fourth shape having a proportional relationship with the first shape based upon a non-whole number.

44. The antenna of claim 40 wherein the radiator first shape has a first effective electrical length conducive to electro-magnetic communications in the range between 824 and 894 megahertz (MHz).

45. The antenna of claim 40 wherein the radiator second shape has a second effective electrical length conducive to electro-magnetic communications in the range between 1565 and 1585 MHz.

46. The antenna of claim 42 wherein the radiator third shape has a third effective electrical length conducive to electro-magnetic communications in the range between 1850 and 1990 MHz.

47. The antenna of claim 43 wherein the radiator fourth shape has a fourth effective electrical length conducive to electro-magnetic communications in the range between 2400 and 2480 MHz.

48. The antenna of claim 40 further comprising:

at least one counterpoise having a third shape with a third effective electrical length, the third shape having a proportional relationship with the first shape based upon a non-whole number.

49. The antenna of claim 48 further comprising:

at least one counterpoise having a fourth shape with a fourth effective electrical length, the fourth shape having a proportional relationship with the first shape based upon a non-whole number.

50. The antenna of claim 40 in which the antenna is selected from the group including patch, monopole, and dipole antennas.

51. The antenna of claim 40 wherein the radiator second shape has a second effective electrical length conducive to electro-magnetic communications in the range between 2400 and 2480 MHz.

52. A method for forming a recursive pattern multiband antenna for wireless telephone communications, the method comprising:

supplying a shape;

forming a first plurality of conductive sections, including a first shape with a first electrical lenath and a second shape with a second electrical length, the first shape having a proportional relationship with the second shape based upon a whole number; and forming a second plurality of conductive sections, including a fourth shape with a fourth electrical length, the fourth shape having a proportional relationship with the first shape based upon a non-whole number.

53. The method of claim 52 wherein forming the first plurality of conductive sections includes forming a third shape having a third electrical length, the first shape having a proportional relationship with the third shape based upon a whole number.

54. The method of claim 53 wherein forming the first plurality of conductive sections includes forming a fourth shape having a fourth electrical length, the first shape having a proportional relationship with the fourth shape based upon a whole number.

55. The method of claim 52 wherein forming a first shape having a first electrical length includes forming an electrical length conducive to electro-magnetic communications in the range of 824 and 894 megahertz (MHz); and wherein forming a second shape having a second electrical length includes forming an electrical length conducive to electro-magnetic communications in the range of 1565 to 1585 MHz.

56. The method of claim 53 wherein forming a third shape having a third electrical length includes forming an electrical length conducive to electro-magnetic communications in the range of 1850 to 1990 MHz.

57. The method of claim 54 wherein forming a fourth shape having a fourth electrical length includes forming an electrical length conducive to electro-magnetic communications in the range of 2400 to 2480 MHz.

58. The method of claim 52 wherein forming conductive sections includes forming an antenna selected from the group including patch, dipole, and monopole antennas.

59. The method of claim 52 wherein forming conductive sections includes forming a bow tie dipole using a recursively generated triangular pattern.

60. The method of claim 52 wherein forming conductive sections includes forming a patch antenna using a recursively generated rectangular pattern.

61. A recursive pattern multiband patch antenna comprising:

a radiator having a first triangle shape and a first effective electrical length; and at least one radiator having a second triangle shape with a second effective length, the second triangle shape having a proportional relationship with the first triangle shape based upon a non-whole number.

62. The antenna of claim 61 further comprising:

at least one radiator having a third triangle shape with a third effective electrical length, the third triangle shape having a proportional relationship with the first triangle shape based upon a non-whole number.

63. The antenna of claim 62 further comprising:

at least one radiator having a fourth triangle shape with a fourth effective electrical length, the fourth triangle shape having a proportional relationship with the first triangle shape based upon a non-whole number.

64. The antenna of claim 61 wherein the radiator first triangle shape has a first effective electrical length conducive to electro-magnetic communications in the range between 824 and 894 megahertz (MHz).

65. The antenna of claim 61 wherein the radiator second triangle shape has a second effective electrical length conducive to electro-magnetic communications in the range between 1565 and 1585 MHz.

66. The antenna of claim 62 wherein the radiator third triangle shape has a third effective electrical length conducive to electro-magnetic communications in the range between 1850 and 1990 MHz.

67. The antenna of claim 63 wherein the radiator fourth triangle shape has a fourth effective electrical length conducive to electro-magnetic communications in the range between 2400 and 2480 MHz.

68. The antenna of claim 61 further comprising:

a dielectric layer underlying the radiator first triangle shape; and, a groundplane underlying the dielectric layer.

* * * * *